US005096125A

United States Patent [19]

Wise et al.

[11] Patent Number: 5,096,125

[45] Date of Patent: Mar. 17, 1992

[54] APPARATUS FOR SYNCHRONIZED SPREADING OF GRANULAR AND LIQUID MATERIAL

[76] Inventors: James J. Wise, 3020 Mason Ave., Las Vegas, Nev. 89102; John A. Doherty, 1 Round Hill Rd., Granby, Conn. 06035

[21] Appl. No.: 592,924

[22] Filed: Oct. 3, 1990

Related U.S. Application Data

[63] Continuation-in-part of Ser. No. 547,950, Jul. 3, 1990, abandoned, and a continuation-in-part of Ser. No. 568,497, Aug. 15, 1990.

[51] Int. Cl.[5] ..... B05B 12/00

[52] U.S. Cl. ..... 239/675; 239/677; 239/684

[58] Field of Search ..... 239/61, 62, 662, 663, 239/670, 672, 675, 677, 684, 127, 71, 74; 180/53.4; 414/518, 526, 528

[56] References Cited

U.S. PATENT DOCUMENTS

| | | | |
|---|---|---|---|
| 3,344,993 | 10/1967 | Wilder et al. | 239/663 |
| 3,420,451 | 1/1969 | Kahlbacher | 239/675 |
| 3,559,894 | 2/1971 | Murray et al. | 239/672 |
| 3,776,431 | 12/1973 | Riley | 239/677 |
| 4,234,109 | 11/1980 | Goodhart | 239/675 |
| 4,260,107 | 4/1981 | Jackson | 239/74 |
| 4,442,979 | 4/1984 | Küpper | 239/663 |
| 4,881,371 | 11/1989 | Haeder et al. | 180/53.4 |

FOREIGN PATENT DOCUMENTS

| | | | |
|---|---|---|---|
| 3712452 | 11/1988 | Fed. Rep. of Germany . | |
| 2229812 | 12/1974 | France | 239/662 |
| 2378132 | 9/1978 | France | 239/662 |
| 516050 | 7/1968 | Switzerland . | |

OTHER PUBLICATIONS

Epoke Instruction Manuel No. 86,02-253 2543 for PWB HS etc. Spreader Date: 1985-1986.

*Primary Examiner*—Andres Kashnikow
*Assistant Examiner*—Karen B. Merritt
*Attorney, Agent, or Firm*—Gregg I. Anderson

[57] ABSTRACT

A granular and liquid material spreading system mounted on a vehicle. Granular material is moved from a hopper to a delivery means using hydraulic pumps and motors. The hydraulic system also drives a liquid delivery system. A control system is provided to control the amount of granular material and liquid material applied to a surface. The feed rate of liquid delivery is dependent upon the feed rate of the granular material. The liquid feed rate may be changed within a predetermined range. The level of liquid may be sensed to disengage the liquid delivery system. Initiation of liquid delivery reduces the feed rate of granular material by a variably selected percentage.

17 Claims, 5 Drawing Sheets

APPARATUS FOR SYNCHRONIZED SPREADING OF GRANULAR AND LIQUID MATERIAL

CROSS REFERENCE TO RELATED APPLICATION

The present application is a continuation-in-part of U.S. patent application Ser. No. 547,950 filed July 3, 1990, now abandoned, and U.S. patent application Ser. No. 07/568,497, filed Aug. 15, 1990.

BACKGROUND OF THE INVENTION

1. Field of the Invention

The invention relates to a liquid delivery system and control mounted to a granular material spreader mounted on a vehicle for synchronous dispensing of solid or granulated and liquid thawing materials onto a road. The solid or granular materials and the liquid materials are stored in separate vessels and moved to a delivery point for application to the road. The quantity of liquid supplied is synchronized to the rate of delivery of the granular material.

2. Description of the Prior Art

Spreader vehicles or spreader implements for distributing a thawing solution or traction enhancing materials on roads are known. Such spreader vehicles have a granular material delivery system and can include a liquid delivery system, wherein a gravity feed system or a liquid pump supplies thawing liquid from a tank carried by the vehicle. A granular and liquid material spreader is shown in W. Küpper, U.S. Pat. No. 4,442,979. The Küpper patent also shows synchronized delivery of both liquid and granular materials according to the speed of travel of the vehicle. Küpper can deliver only liquid, only granular material or a combination of the two, all proportional to the speed of the vehicle.

Neither Küpper nor any other prior art shows a liquid and granular delivery system using a hydraulic system which selectively varies the feed rate of the liquid material depending upon the extent to which hydraulic flow from the granular material delivery system is diverted to the liquid delivery system. None of the prior art shows a liquid delivery system which varies liquid feed rates from the synchronized feed rate by use of a liquid flow control valve to remove a selected amount of liquid from the liquid delivery system.

None of the prior art shows a variable feed rate of the granular material delivery system dependent on activation of and the feed rate of the liquid delivery system. The prior art does show a fixed reduction feed rate of granular material on activation of a liquid delivery system.

A. Kahlbacher, in U.S. Pat. No. 3,420,451, shows a dispenser for granular road salt which includes a liquid metering device. The metering device is driven by a mechanical cam system connected to the drive shaft of an auger type conveyor. The metering device is mounted in a supply duct to regulate the flow of liquid dependent on the speed of the vehicle. As in other prior art systems, a greater or lesser feed rate of liquid, than established by the granular delivery system, is not available without major adjustment to the liquid delivery system. The granular delivery system feed rate in all prior art but a commercial system built by A/S Alfred Thompson in Rejen, Denmark is unaffected by the mechanical connection to the liquid delivery system, resulting in excess use of granular material. In the A/S Alfred Thompson device, the granular material feed rate is set on activation of the liquid delivery system.

In G. Murray, et al. in U.S. Pat. No. 3,559,894, an aggregate spreading apparatus uses a belt conveyor instead of an auger conveyor. Other prior art granular salt spreaders have means for delivering liquid in combination with or separately from the granular material include: French Patents No. 2,229,812 and 2,378,132; West German Patent No. 3,712,452; and Swiss Patent No. 516,050.

A hydraulic drive and control system wherein the granular delivery system and the liquid delivery system are interconnected to vary both the granular and liquid feed rate separately has not been shown. W. Küpper combines a single hydraulic drive and delivery system which is incapable of varying feed rate of the liquid material. The feed rate is typically dependent on speed of the vehicle on which the spreading device is mounted. Some prior art systems do allow the operator to change the granular feed rate independent of vehicle speed. Gravity or electric liquid feed systems also exist which are not dependent on speed of the vehicle, but those systems do not synchronize granular and liquid feed rates.

OBJECTS AND SUMMARY OF THE INVENTION

It is the principal object of the present invention to provide a control device for synchronizing the feed rate of granular and liquid materials wherein the feed rate of a liquid delivery system can be selectively set to a constant within a range of the synchronized feed rate established by an interconnected granular delivery system.

It is a related object of the present invention to provide a control device for synchronizing the feed rate of granular and liquid materials wherein the synchronized feed rate for granular materials is directly and proportionately changed or altered upon activation of the liquid delivery system.

It is a further related object of the present invention to provide a control device for synchronizing the feed rate of granular and liquid materials wherein the feed rate for granular materials is proportionately changed upon activation of the liquid delivery system and the feed rate of granular and liquid materials can be independently varied.

In accordance with the objects of the invention, a vehicle has mounted thereon a granular material delivery system and a thawing liquid delivery system, including a storage tank. The granular material, such as salt, can be used separately or in combination with the liquid, typically calcium chloride, for thawing road surfaces during winter months. A hydraulic system powers a delivery system or conveyor to deliver the granular material from a hopper to a spinner, which distributes the granular material. The spinner is powered by the same hydraulic system and together the hydraulic system, hopper, conveyor and spinner define the granular delivery system.

The liquid delivery system is mechanically, electronically or hydraulically connected to the granular delivery system. A motor of the liquid delivery system drives a liquid pump of the liquid delivery system. The feed rate of the liquid delivery system is interconnected to the granular delivery system for synchronous operation. The liquid feed rate may be changed by a flow control valve, which returns a selected portion of liquid to the storage tank.

None, a portion or all of the hydraulic flow from the granular delivery system may be siphoned off to the motor that powers the liquid delivery system or, in some embodiments, returned to the hydraulic reservoir. In either event, the feed rate of the granular delivery system is thereby proportionately changed or altered, depending upon the amount of hydraulic flow siphoned off the granular delivery system. The amount of liquid delivered remains proportional to the granular delivery system. The amount or feed rate of granular material is reduced, based upon the percentage of hydraulic flow removed from the granular delivery system. The amount of hydraulic flow removed from the granular delivery system can range from 0 to approximately 95 percent, depending on the embodiment chosen and the road conditions the operator of the vehicle may experience.

Where the granular feed rate is otherwise reduced by the connection to and activation of the liquid delivery system, the operator still can vary the respective feed rates within a range. The operator can select the correct material mix to control road conditions.

Other aspects, features and details of the present invention can be more completely understood by reference to the following detailed description of the preferred embodiments, taken in conjunction with the drawings, and from the appended claims.

DESCRIPTION OF THE PREFERRED EMBODIMENTS

Figure 1:
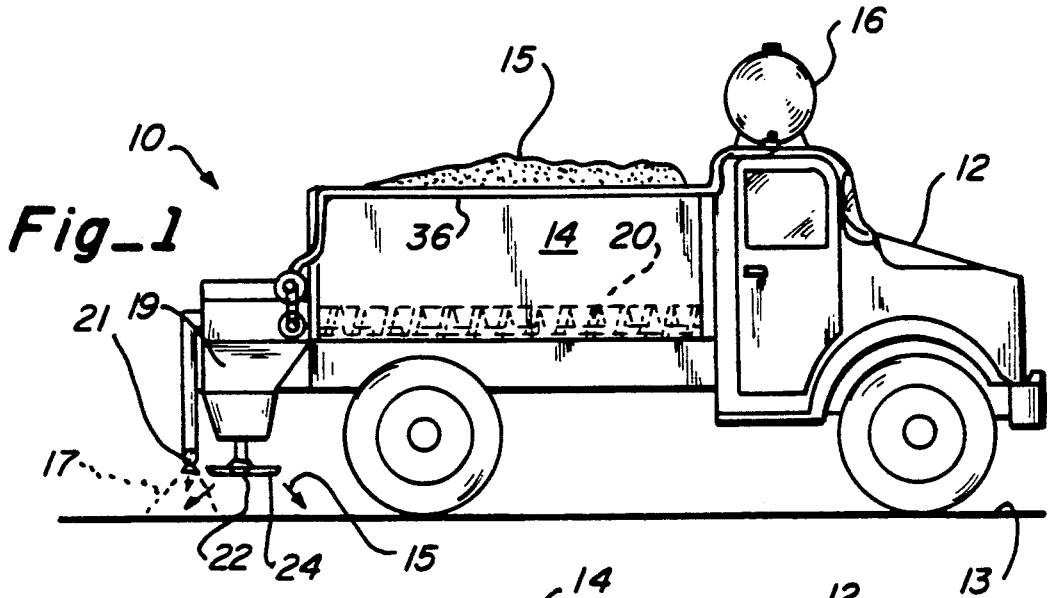
FIG. 1 is a side elevational view of a vehicle carrying the granular and liquid material control device of the present invention.
Figure 2:
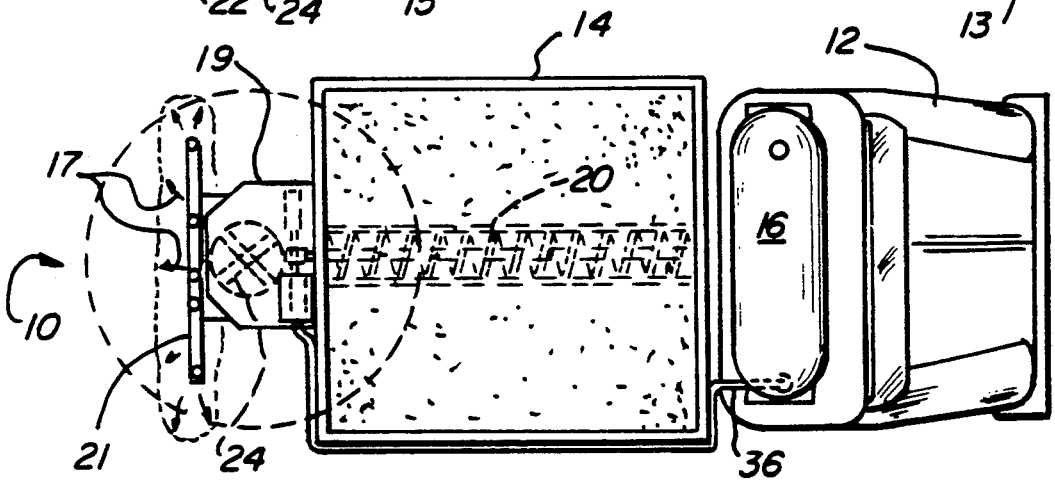
FIG. 2 is a top plan view of the vehicle shown in FIG. 1.

A synchronized control device (FIGS. 3 and 5 through 10) for a spreader 10 (FIGS. 1 and 2) mounted on a vehicle 12 for spreading granular material 15 and a thawing liquid 17 (FIG. 3) onto a road 13. The granular material 15 may be salt, sand for traction or any solid or aggregate material that may be spread onto the road 13. The liquid 17 may be calcium chloride, sodium chloride or other chloride compound liquid, as well as any other wetting or thawing agent. The granular material 15 and thawing liquid 17 are applied when the road 18 has ice or snow covering it which needs to be melted. These situations occur on public streets and highways as well as in and around public transportation areas such as airports.

Figure 3:
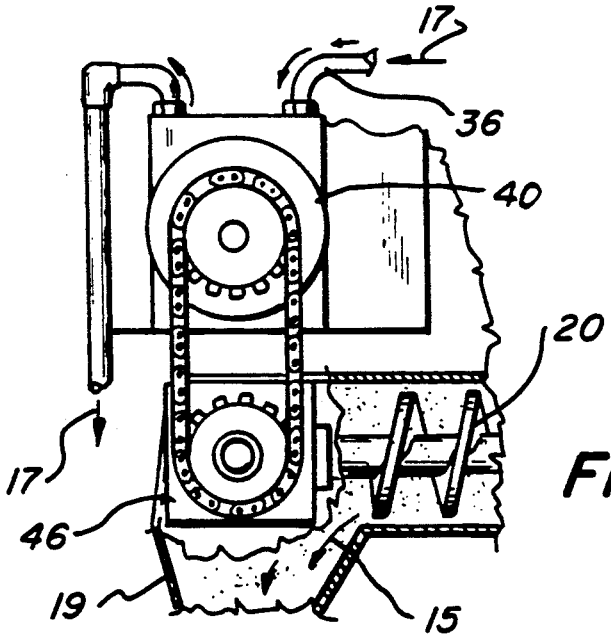
FIG. 3 is a fragmentary schematic view showing a typical mechanical embodiment for connecting a conveyor of a granular material delivery system to a liquid material delivery system.

The granular material 15 is carried in a hopper 14 or similar device mounted on the vehicle 12. As in the prior art, the hopper 14 is open to deposit the granular material 15 onto a conveyor 20, moving the granular material 15 to a drop chute 19. A delivery position is defined at the drop chute 19, where the granular material 15, with the liquid 17, falls onto a spinner 24. The spinner 24 is rotated by a spinner motor 22 to define delivery means for spreading the granular and liquid materials 15 and 17 onto the road 18 (FIG. 3). The liquid 17 is stored in a tank 16 and pumped to nozzles 21 at the delivery position. The liquid may be applied either directly to the road or onto the spinner.

Figure 4:
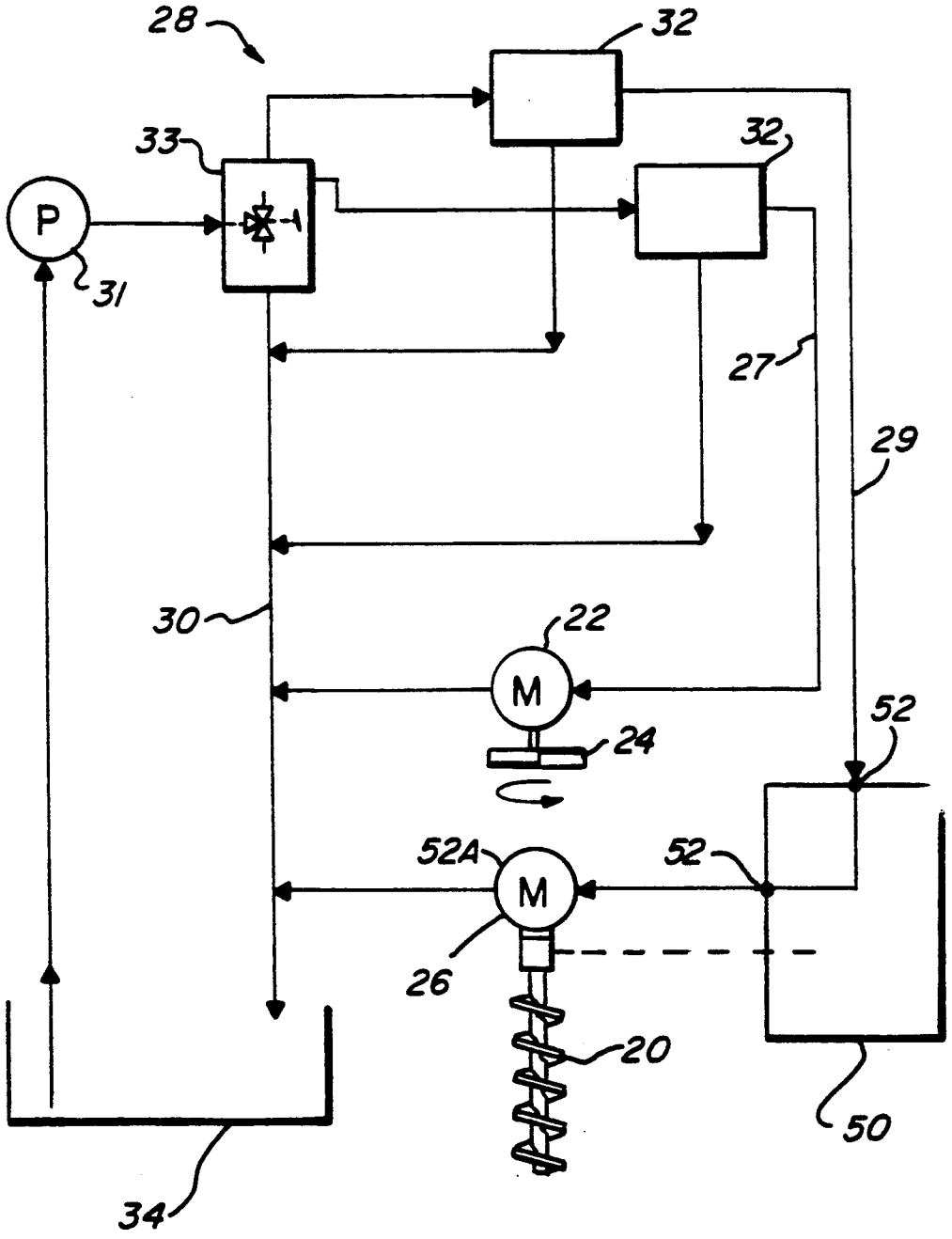
FIG. 4 is a schematic view of the hydraulic system of the granular delivery system.

The spinner motor 22 is part of a hydraulic system 28 (FIG. 4), which hydraulic system 28 also operates the conveyor 20 via a conveyor motor 26. The hydraulic system 28 is typical of such systems known and in use in the prior art. A power take off connection from an engine mounted on the vehicle 12 turns hydraulic pump 31. When the hydraulic system 28 is turned on at switch 33, hydraulic fluid is diverted as shown in FIG. 4 to an hydraulic line 27 for the spinner motor 22 and line 29 for the conveyor motor 26. Rotary valves 32 in lines 27 and 29 determine the amount of hydraulic fluid delivered. If the hydraulic system 28 is turned off at the switch 33, hydraulic fluid is returned to a fluid reservoir 34, through by-pass line 30.

While the conveyor 20 is shown as an auger type conveyor, it could be a roller device or belt conveyor, depending upon the choice of the user. A granular material delivery system 23 (FIGS. 5, 6) is comprised of the hydraulic system 28, the hopper 14, the conveyor 20 and the spinner 24.

A liquid delivery line 36 carries the liquid 17 from the storage tank 16 to one or more of the nozzles 21 which apply the liquid 17 under pressure to the falling granular material 15 generally at the spinner 24. The granular material 15 and liquid 17 are deposited on the road 13 by the spinner 24. In a manner known in the art, the area covered is determined by the rotational speed of the spinner 24, while the amount of granular material 15 dispensed is determined by the speed of the conveyor 20, as well as mechanical considerations related to the hopper 14. These mechanical considerations, as well as ground speed sensing control for increasing or decreasing the granular material feed rate dependent on vehicle speed, are known in the prior art.

A liquid delivery system 25 is added onto the granular delivery system 23 and includes, generally, the tank 16, the delivery lines 36, a liquid system motor 38, a liquid system pump 40, a liquid flow control valve 42, a flow meter 44 and the distribution nozzles 21. (FIGS. 5–8). The liquid delivery system 25 is interconnected to the granular material delivery system 23 to synchronize the feed rate of the liquid 17 to the granular material 15.

The liquid pump 40 of the liquid delivery system 25 is mechanically connected through a gear box 46 to a shaft of the conveyor 20 in a mechanical embodiment. (FIG. 3). In the hydraulic embodiments of FIGS. 5 through 10, the pump 40 is mechanically connected to the liquid system motor 38, which is in fluid communication with the hydraulic system 28 of the granular delivery system 23.

The liquid pump 40 partially sets the feed rate of the liquid 17 supplied to the liquid flow control valve 42, which finalizes the amount or feed rate of the liquid 17 delivered to the nozzles 21. The liquid flow control valve 42 returns a selected amount of the liquid 17 to the tank 16. The amount is infinitely variable over a given range and directly determines the feed rate of the liquid 17. The feed rate then remains constant until changed. In all of the embodiments shown in FIGS. 3 and 5 through 10, the liquid pump motor 38 (not shown in FIG. 3) and the liquid pump 40 are connected so that the feed rates of the granular material 15 and liquid 17 are likewise synchronous, depending upon the speed of the conveyor 20. Variation of liquid flow rate to granular flow rate is partially achieved by altering the amount of the liquid 17 returned to the tank 16 through the liquid flow control valve 42. Liquid flow is further affected by diverting hydraulic fluid from the hydraulic system 28, as will be described in reference to the embodiments of FIGS. 7 through 10.

Figure 5:
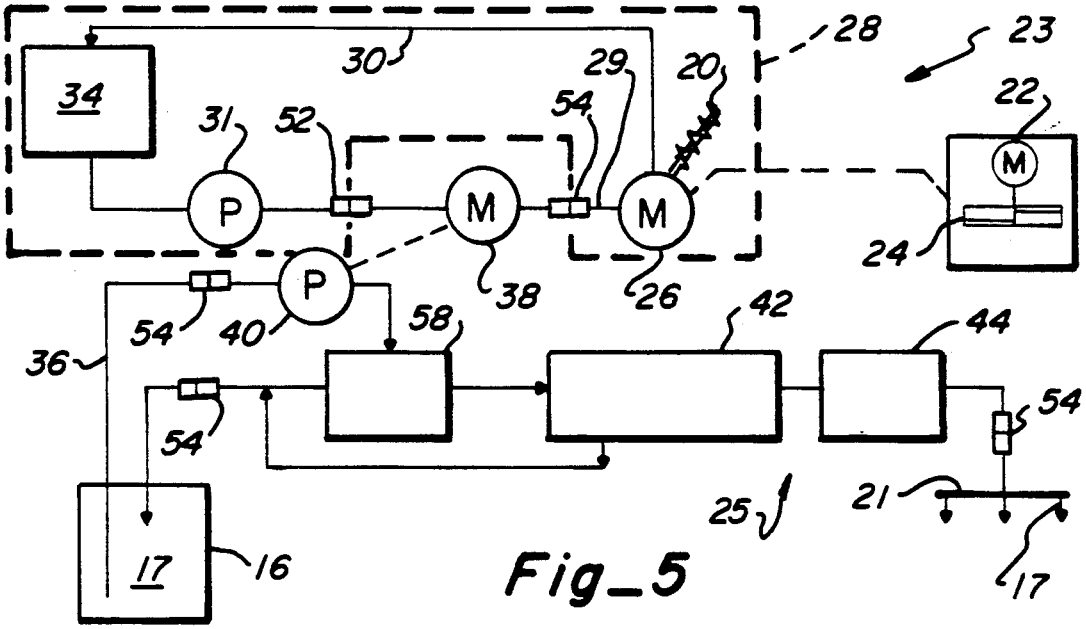
FIG. 5 is a block diagram of a first alternative hydraulic embodiment of the granular and liquid delivery system of the invention.
Figure 6:
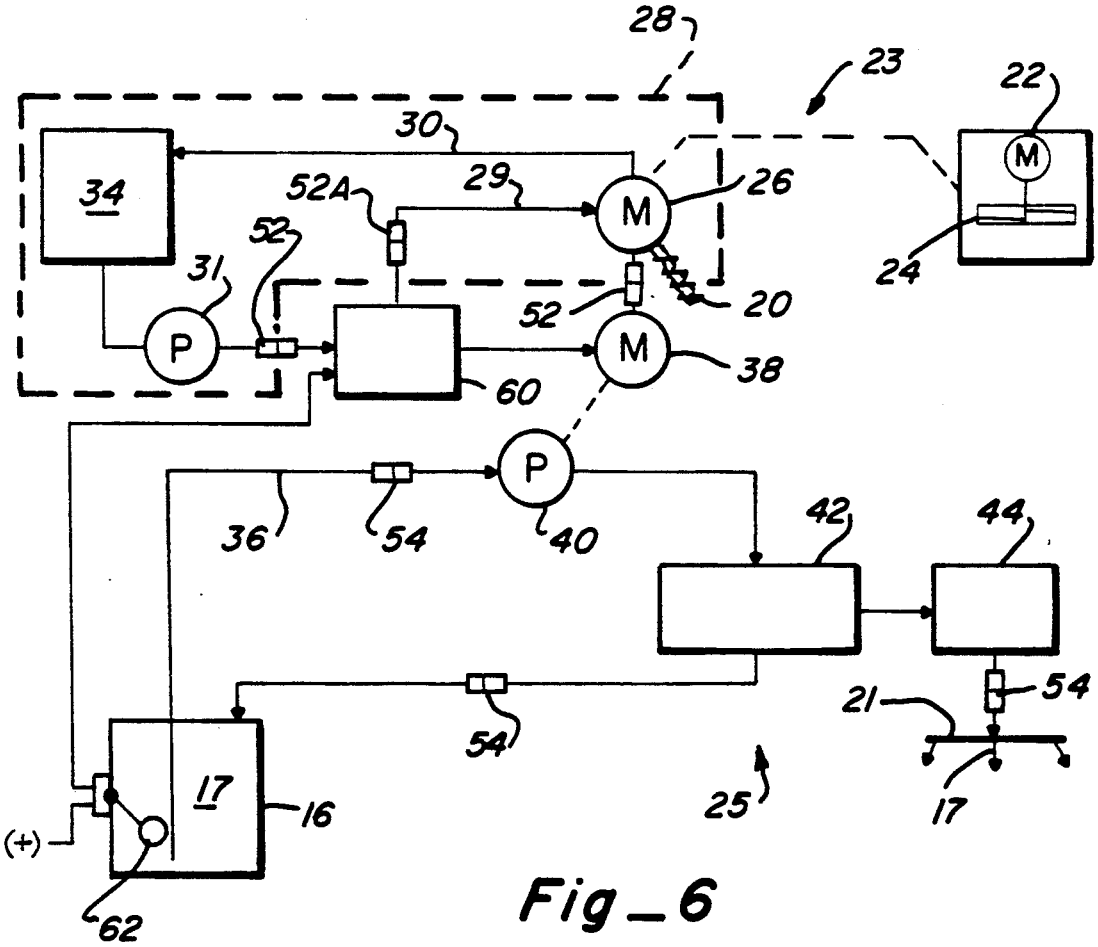
FIG. 6 is a schematic view of a second alternative hydraulic embodiment of the invention.

Like parts retain the same numbers in the following description of the embodiments. Different embodiments of the liquid delivery system 25 and its connection to the granular delivery system 23 are shown in FIGS. 3 and 5 through 10. In FIGS. 5 through 10, the hydraulic lines connecting the spinner motor 22 and the spinner 24 to the remainder of the hydraulic system 28 are shown schematically for clarity. The embodiments of FIGS. 5 and 6 are similar in that the hydraulic fluid is not diverted from the hydraulic system 28. In the embodiments shown in FIGS. 7 and 8, a hydraulic fluid flow control valve 48 and a direction control valve 50 are upstream of the conveyor motor 26. Hydraulic fluid flow is diverted from the hydraulic system 28 through the flow control valve 48, at the discretion of the operator, to between 0 and approximately 95% of the total hydraulic fluid flow. This provides much greater flexibility in adjusting the granular material 15 usage to the temperature, wind, depth and types of precipitation.

In all embodiments of the liquid delivery system 25 the connection between the granular delivery system 23 and the pump 40 provides for synchronous delivery of liquid 17. The faster that granular material 15 is delivered by the granular delivery system 23, specifically the conveyor motor 26, the more rapid a rate that liquid 17 is applied. This is necessary to keep the ratio of the liquid 17 to the granular material 15 constant, i.e., synchronous.

The entire liquid delivery system 25 can be removed from the spreader device 10 through quick release disconnects 52 and 54. The quick release disconnects 52 remove the liquid delivery system 25 from the hydraulic system 28 as will be described shortly. The quick release disconnects 54 allow the liquid delivery system 25 to be separated from the liquid tank 16 and the nozzles 21. Removal of the liquid delivery system 25 is provided so that testing, calibration, repair or even replacement can be accomplished in as quick and timely a manner as possible. While the liquid delivery system 25 is removed, the granular delivery system 23 is operable in a normal manner. The connections 52 of the embodiment of FIGS. 3 and 5 through 9 to the hydraulic system 28 are shown in FIG. 4.

The mechanical embodiment of FIG. 3 directly connects a rotating shaft of the conveyor 20 to the liquid system pump 40. (FIGS. 3 and 4). The connection establishes a synchronous feed rate between the liquid 17 and the granular material 15. The liquid delivery system 25 of this embodiment is as discussed in reference to the embodiment of FIG. 5, which will now be described.

In the embodiment shown in FIG. 5, the hydraulic system 28 includes the hydraulic fluid tank 34 from which hydraulic fluid is delivered into the hydraulic fluid lines 29 and 30. The liquid system motor 38 is connected to the hydraulic system 28 intermediate to the pump 31 and the separate conveyor motor 26 at quick release disconnects 52, 54. The hydraulic fluid flow in the line 29 is used by the motor 38 to establish a rotary motion to turn the pump 40 of the liquid delivery system 25. The hydraulic flow in the line 29 also powers the conveyor 20 through the separate conveyor motor 26.

Still referring to FIG. 5, the pump 40 is synchronized mechanically to the granular material delivery system 23. Liquid 17 from the liquid storage tank 16 is drawn through the delivery line 36 by the pump 40 and through a liquid direction control valve 58 either back to the storage tank 16 or to the flow control valve 42. If the liquid 17 is returned to the storage tank 16, no liquid 17 is applied to the granular material 15. If the liquid 17 passing through the direction control valve 58 is not returned to the tank 16, then adjustment of the flow control valve 42 determines how much of the liquid 17 is applied to the nozzles 21 and how much is returned to the tank 16. The flow control valve 42 therefore determines the amount of liquid 17 applied to the road 18 and adjusts, up or down, the ratio of feed rates of liquid 17 to the granular material 15 that is dictated by the interconnection between the pump 40 and the motor 38. The flow meter 44 measures the rate of flow of the liquid 17 so that the ratio of liquid 17 to granular material 15 can be measured and analyzed at a later date.

In the embodiment shown in FIG. 6, using a hydraulic direction control valve 60, the granular material delivery system 2 selectively diverts all of the hydraulic flow away from the hydraulic system 28 to the liquid system motor 38 of the liquid delivery system 25. The conveyor motor 26 receives the fluid flow either directly or through the liquid system motor 38, mounted in line or in series with the conveyor motor 26, to turn the conveyor 20. In the first setting of the direction control valve 60, the liquid delivery system 25 is activated or on. In the second setting of the valve 60, only the operation of the separate conveyor motor 26 is selected. In that case, the liquid delivery system 25 is off. In a similar manner to that described with reference to FIG. 5, the direction control valve 60 and the liquid system motor 38 are inserted into the hydraulic line 29 intermediate to the pump 31 and the conveyor motor 26 at the quick release disconnects 52. The second setting of the direction control valve 60 requires a third quick release disconnect 52A to the hydraulic system 28. The quick release disconnect 52A interconnects the direction control valve 60 and the motor 26 (FIG. 4).

If the liquid delivery system 25 is on, i.e., motor 38 is activated by setting the direction control valve 60, then the pump 40 operates as previously described forcing fluid through the flow control valve 42 and the flow meter 44 to the nozzles 21. A liquid level indicator 62 can be mounted in the liquid tank 16 selecting the first setting, to turn off the liquid delivery system 25 at the direction control valve 60, if the liquid 17 goes below a certain predetermined level.

Figure 7:
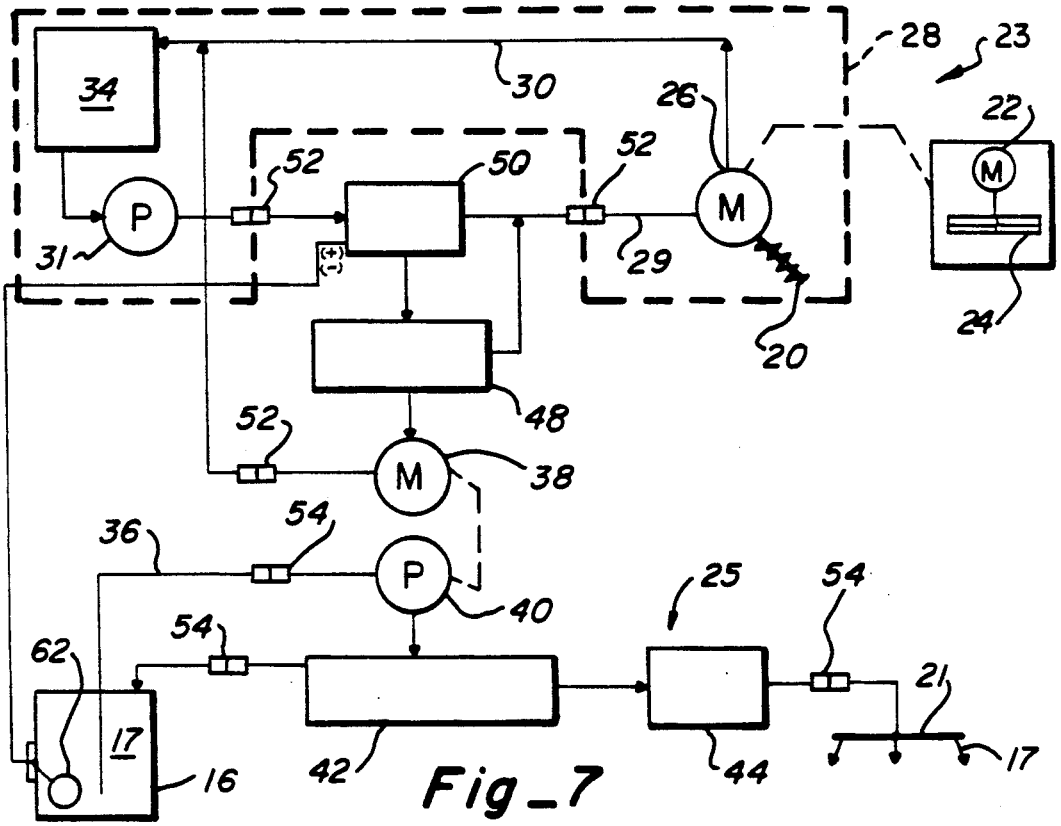
FIG. 7 is a schematic view of a third alternative hydraulic embodiment of the invention.

In the embodiment shown in FIG. 7 the hydraulic direction control valve 50 is utilized in a first setting to solely direct fluid to the separate conveyor motor 26 or, through the hydraulic flow control valve 48, in a second setting directs fluid to the liquid system motor 38 and the conveyor motor 26. As has been discussed in other embodiments, if the separate conveyor motor 26 is selected by the direction control valve 50, the liquid delivery system 25 is shut off. If the flow control valve 48 is selected by the direction control valve 50, a selected constant percentage of the hydraulic fluid is available to operate the liquid system motor 38, with the balance operating the separate conveyor motor 26.

The diverted hydraulic fluid is returned to the reservoir 34. The percent of fluid diverted to the motor 38 is set at a constant but may be changed to any of an infinite number of settings over a range by the operator, altering the feed rate of the granular delivery system 23. The flow control valve 48 and direction control valve 50 thereby define diversion means for diverting hydraulic fluid from the granular material delivery system 23 to the liquid delivery system 25. The direction control valve 50 is connected at the quick release disconnects 52 intermediate the pump 31 and the conveyor motor 26, defining the connection 56 to the hydraulic system 28 (FIG. 4).

As before, the liquid system motor 38 mechanically drives the pump 40, the liquid 17 is forced through the variable flow control valve 42 and the flow meter 44 to the nozzles 21. The level indicator 62 operates the direction control valve 50 to enable or disable the liquid delivery system 25, depending upon the level of liquid 17 in the tank 16.

Figure 8:
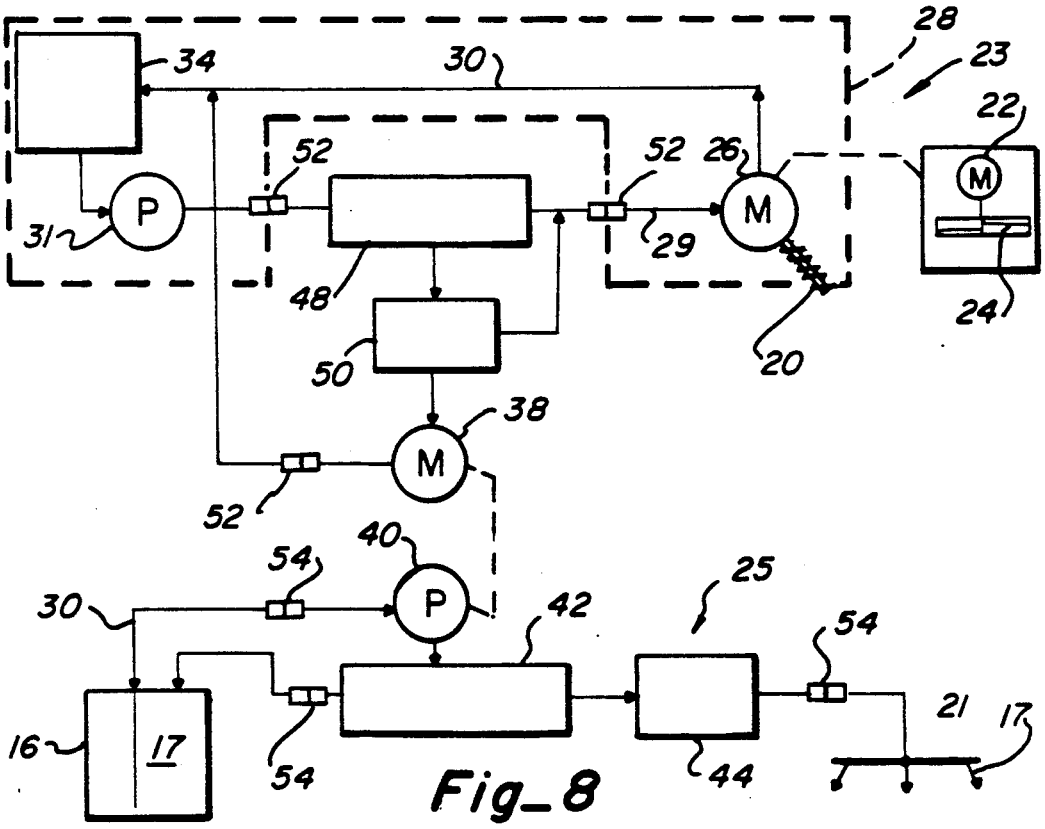
FIG. 8 is a schematic view of a fourth alternative hydraulic embodiment of the invention.

In the embodiment shown in FIG. 8, a desired percentage of hydraulic fluid is diverted at the variable flow control valve 48 from hydraulic system 28 to the liquid delivery system 25. The direction control valve 50 may restore the diverted percentage of hydraulic fluid to the separate conveyor motor 26 or activate the liquid delivery system 25 by supplying the diverted hydraulic fluid to the liquid system motor 38. All of the hydraulic fluid is eventually returned to the hydraulic storage tank 34. The flow control valve 48 is again interconnected into the hydraulic line 29 at the quick release disconnects 52 (FIG. 4).

Figure 9:
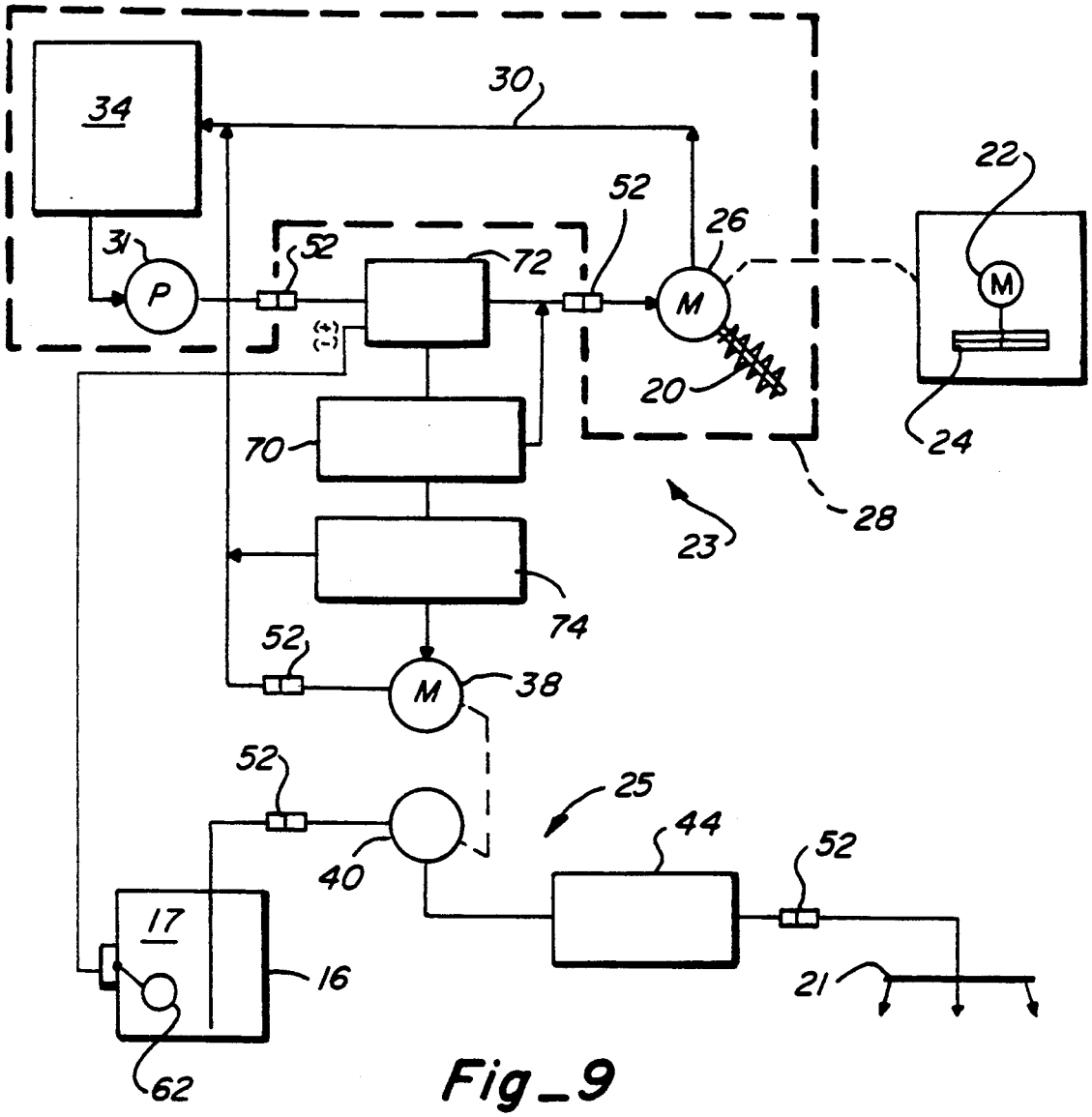
FIG. 9 is a schematic view of a fifth alternative hydraulic embodiment of the invention.

In the embodiment shown in FIG. 9, the feed rate of the liquid delivery system 25 is controlled entirely through the hydraulic system 28. This eliminates the need for the liquid flow control valve 42. Rather, the first and second variable control values 70 and 74, as well as directional flow control valve 72, are placed in the hydraulic system 28 upstream of the liquid system motor 38.

In a manner analogous to the other embodiment, FIG. 9 shows a circuit in which hydraulic fluid is removed from the reservoir 34 and delivered into the hydraulic lines 30 under pressure imparted by the hydraulic pump 31. Hydraulic fluid passes through a direction control valve 72 downstream of the pump 31. As before, depending on the position of the direction flow control valve 72, the liquid delivery system 25 is either on or off. If the flow control valve 72 is set to turn the liquid delivery system 25 off, then all the hydraulic fluid is directed toward the conveyor motor 26 of the granular delivery system 23. If the direction flow control valve 72 is on, then the hydraulic fluid is directed through the first variable flow control valve 70, which sets the percentage of reduction as has been discussed with respect to FIGS. 7 and 8. A percentage of hydraulic fluid is diverted to the liquid delivery system 25, and the remainder is used to drive the granular delivery system 23. Hydraulic fluid then passes through the second variable flow control valve 74. At the control valve 70, the feed rate of the liquid delivery system 25 is set. Depending on the setting of the second variable flow control valve 74, the liquid delivery system 25 operates at a full feed rate for the liquid 17 or at a lesser feed rate. In this manner, the amount of hydraulic fluid supplied to the pump motor 38 controls the feed rate of the liquid 17, rather than the flow control valve 42 of the other alternative embodiments. As in the alter embodiments, the liquid feed rate is constant within a range. As seen in FIG. 9, any excess hydraulic fluid is returned to the hydraulic system 28 and eventually to the reservoir 34.

It will be apparent to those of skill in the art that the position of the direction control valve 72 and the variable flow control valve 70 can be switched to achieve the identical operational result. A level indicator can be included to force the directional flow control valve 72 off.

In the embodiments of FIGS. 7, 8, 9 and 10, the diversion means for diverting hydraulic fluid from the granular material delivery system 23 proportionately reduce the speed of the conveyor 20 by a percentage equal to the amount of fluid diverted away from the conveyor motor 26 to the reservoir 34. The feed rate of the granular delivery system 23 is reduced, and the amount of granular material 15 deposited on the road 13 is likewise reduced, while synchronous operation with the liquid delivery system 25 is maintained. If the diversion means is off, then the conveyor 20 returns to its previous operational speed. This is best seen in the following examples, which compare the embodiments of FIGS. 3, 5 and 6, which do not reduce the feed rate of the granular delivery system 23, to the embodiments of FIGS. 7, 8 and 9, which do reduce the feed rate.

| | FIG. 3 | FIG. 5 | FIG. 6 | FIG. 7 | FIG. 8 | FIG. 9 |
|---|---|---|---|---|---|---|
| | EXAMPLE 1 | | | | | |
| Engine RPM | 1000 | 1000 | 1000 | 1000 | 1000 | 1000 |
| Inlet Hydraulic Fluid Flow in GPM | 10 | 10 | 10 | 10 | 10 | 10 |
| Hydraulic Fluid Diversion: | | | | | | |
| Percent Diverted to Liquid Delivery System | N/A | N/A | N/A | 30% | 30% | 30% |
| Gallons Diverted to Liquid Delivery System | N/A | N/A | N/A | 3 | 3 | 3 |
| Conveyor Speed in RPM: | | | | | | |
| Without Fluid Diversion | 50 | 50 | 50 | 50 | 50 | 50 |
| With Fluid Diversion | 50 | 50 | 50 | 35 | 35 | 35 |
| Granular Material Usage: | | | | | | |
| Salt-(lbs. Per Lane Mile) | | | | | | |
| Without Fluid Diversion | 400 | 400 | 400 | 400 | 400 | 400 |
| With Fluid Diversion | 400 | 400 | 400 | 280 | 280 | 280 |
| Salt Savings Due to Diversion | N/A | N/A | N/A | 120 | 120 | 120 |
| During Liquid Application: | | | | | | |
| Liquid Material Usage: | | | | | | |

-continued

| | FIG. 3 | FIG. 5 | FIG. 6 | FIG. 7 | FIG. 8 | FIG. 9 |
|---|---|---|---|---|---|---|
| Without Fluid Diversion | 20 | 20 | 20 | 0 | 0 | 0 |
| With Fluid Diversion | 20 | 20 | 20 | 14 | 14 | 14 |
| Liquid Savings Due to Diversion | N/A | N/A | N/A | 6 | 6 | 6 |
| EXAMPLE 2 | | | | | | |
| Engine RPM | 2000 | 2000 | 2000 | 2000 | 2000 | 2000 |
| Inlet Hydraulic Fluid Flow in GPM | 20 | 20 | 20 | 20 | 20 | 20 |
| Hydraulic Fluid Diversion: | | | | | | |
| Percent Diverted to Liquid Delivery System | N/A | N/A | N/A | 30% | 30% | 30% |
| Gallons Diverted to Liquid Delivery System | N/A | N/A | N/A | 6 | 6 | 6 |
| Conveyor Speed in RPM: | | | | | | |
| Without Fluid Diversion | 100 | 100 | 100 | 100 | 100 | 100 |
| With Fluid Diversion | 100 | 100 | 100 | 70 | 70 | 70 |
| Granular Material Usage: | | | | | | |
| Salt-(lbs. Per Lane Mile) | | | | | | |
| Without Fluid Diversion | 800 | 800 | 800 | 800 | 800 | 800 |
| With Fluid Diversion | 800 | 800 | 800 | 560 | 560 | 560 |
| Salt Savings Due to Diversion | N/A | N/A | N/A | 240 | 240 | 240 |
| During Liquid Application: | | | | | | |
| Liquid Material Usage: | | | | | | |
| Without Fluid Diversion | 40 | 40 | 40 | 0 | 0 | 0 |
| With Fluid Diversion | 40 | 40 | 40 | 28 | 28 | 28 |
| Liquid Savings Due to Diversion | N/A | N/A | N/A | 12 | 12 | 12 |

The assumptions in the foregoing examples are a 30% reduction in conveyor speed due to diversion of fluid. It is also assumed that the ratio of the liquid 17 to the granular material (salt) 15 will be 5% by weight. Use of the embodiments of FIGS. 7, 8 and 9 reduces use of salt 120 lbs. and liquid 6 gallons in Example 1. For Example 2, the reductions are 240 lbs. and 12 gallons.

Those of ordinary skill in the art will appreciate that reduction, or proportional change, of the feed rate of the granular delivery system 23 may result from other mechanical and electronic means. Specifically, the liquid feed rate could be measured electronically, and a signal proportional to the feed rate would proportionately open and close a valve (not shown) in the hydraulic system 28. The opening and closing of the valve would affect the amount of hydraulic fluid supplied to the conveyor motor 26, raising or lowering the feed rate of granular material.

In all of the embodiments discussed, reduction of the feed rate of the granular delivery system 23 resulted from diversion of hydraulic fluid to the liquid delivery system 25. It is also contemplated in the embodiment shown in FIG. 10 of the present invention to reduce the feed rate of the granular delivery system 23 by diverting hydraulic fluid from the conveyor motor 26 in a proportional amount and returning the hydraulic fluid to the reservoir 34 rather than to the liquid delivery system 25. Such a diversion is accomplished by a variable flow control valve 82 and a direction control valve 80 similar to valves 48 and 50 described in reference to the embodiment shown in FIG. 7. The variable flow control valve 82 is placed in line so as to be upstream from the conveyor motor 26. A proportional amount of hydraulic fluid is thus directed to the liquid and conveyor motors 38 and 26 and the remaining and proportional amount of hydraulic fluid in the hydraulic system 28 is returned to the reservoir 3 by the variable flow control valve 82.

To achieve the desired reduction of the granular material feed rate, the variable flow control valve 82 returns the remaining proportional amount of the hydraulic fluid to the reservoir 34. The direction control valve 80 can be electronically connected as described previously to activate or deactivate the liquid delivery system 25. If the direction control valve 80 is set to direct fluid to the conveyor motor 26 only, no reduction in hydraulic flow, and, therefore, no reduction in granular material feed rate occurs nor is liquid added.

Figure 10:
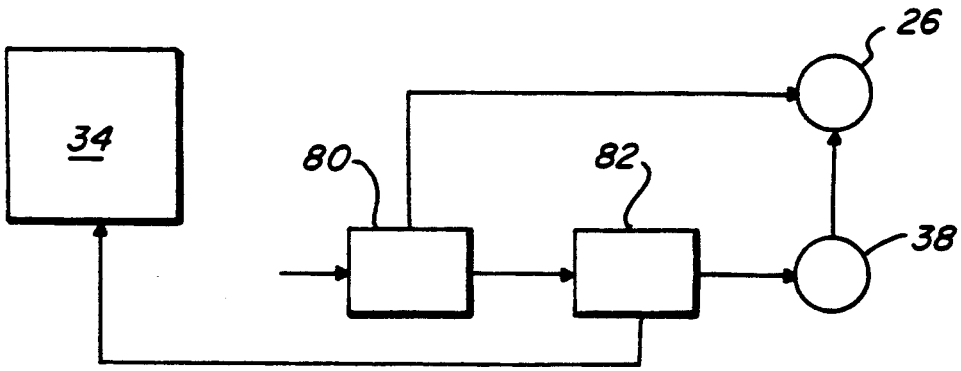
FIG. 10 is a schematic view of a sixth alternative hydraulic embodiment of the invention.

The liquid system motor 38 in the embodiment of FIG. 10 could be placed in series with the conveyor motor 26 on either side thereof. The only requirement is that the liquid system motor 38 be downstream of the variable flow control 82. Other arrangements of the valves and motors will be apparent to those of ordinary skill in the art.

In the embodiment of FIG. 10, reduction of the granular delivery system 23 occurs by returning a selected percentage, the remaining proportional amount of hydraulic fluid to the reservoir 34 at a position prior to or upstream of the conveyor motor 26. Returning the hydraulic fluid to the reservoir 34 lowers hydraulic flow and, therefore, the speed of the conveyor motor 26.

Although the invention has been described with a certain degree of particularity, the scope of the invention as defined in the appended claims.

We claim:

1. In a synchronized granular and liquid spreader device mountable on a vehicle including a hydraulic system and comprising a storage hopper for containing granular material, a granular delivery system mounted on said vehicle for distributing granular material from said hopper, said hopper depositing said granular material onto conveyor means driven by said hydraulic system, said conveyor means moving the granular material to a delivery position, delivery means at said delivery position for receiving and distributing said granular material; a liquid storage tank, a liquid delivery system interconnected to said granular delivery system for supplying liquid material, means for selectively actuating said liquid delivery system for adding the liquid to the granular material generally at the delivery position; and control means for controlling the synchronous feed rate of the granular and liquid materials, the improvements in said control means comprising means for selectively setting the liquid feed rate within a range of feed rates, means for selectively setting the granular delivery system feed rate over a selected range of feed rates of granular material; means for maintaining a predetermined ratio of the feed rate of liquid material to the feed rate of granular material and means operative in response to actuation of said liquid delivery system for reducing by a variably selected percentage the quantity of granular material delivered by said granular material delivery system while maintaining said predetermined ratio of the feed rates of delivery of liquid material and granular material.

2. The spreader device as defined in claim 1, wherein said control means further includes diversion means for diverting a selected percentage of hydraulic fluid from the hydraulic system of the granular delivery system to the liquid delivery system and thereby slowing the speed of said conveyor means and lowering the feed rate of the granular material.

3. The spreader device as defined in claim 1, wherein said control means further including liquid level indication means for sensing the level of liquid in the storage tank and if the liquid level is below a predetermined set value disengaging the liquid delivery system.

4. The spreader device as defined in claim 1, wherein said hydraulic system further includes:

a pump operated through a power take off from an engine mounted on said vehicle;

a liquid system motor operative on said pump and connected to a liquid system pump, said liquid system pump for moving the liquid from the storage tank to the delivery means; and a separate conveyor motor for operating said conveyor.

5. The spreader device as defined in claim 4, wherein said liquid delivery system further includes a direction control valve downstream of said liquid pump and upstream of said flow control valve for returning the liquid to the storage tank or directing it through said flow control valve.

6. The spreader device as defined in claim 5, wherein said liquid delivery system further includes a flow meter to determine the rate of flow of the liquid.

7. The spreader device as defined in claim 1, wherein said hydraulic system further includes:

a pump operated through a power take off from an engine mounted on said vehicle;

a direction control valve for directing hydraulic fluid, which direction control valve in a first setting directs the fluid to operate a conveyor motor for driving the conveyor means or in a second setting directs the fluid to operate a pump motor of the liquid delivery system and the conveyor means.

8. The spreader device as defined in claim 7, wherein said liquid delivery system further includes liquid level indication means for selecting the first setting of said direction control valve if liquid in the storage tank falls below a preselected level.

9. The spreader device as defined in claim 8, wherein said liquid delivery system further includes a flow meter to determine the rate of flow of the liquid.

10. The spreader device as defined in claim 1, wherein said hydraulic system further includes:

a hydraulic pump operated through a power take off from an engine mounted on said vehicle; a liquid system motor operatively driven by said hydraulic pump and mechanically connected to a liquid system pump, said liquid system pump operative for moving the liquid from the storage tank to the delivery means; a separate conveyor motor operatively driven by said hydraulic pump for operating said conveyor; and the further improvement in said control means comprising a hydraulic direction control valve for directing hydraulic fluid, which direction control valve in a first setting directs the fluid to operate said conveyor motor for driving the conveyor means or in a second setting directs the hydraulic fluid to a second flow control valve, said second flow control valve operative for diverting a selected percentage of the fluid to said separate conveyor motor and the remaining percentage to said liquid system motor for driving said liquid delivery system thereby to alter the feed rate of the granular material by reducing the fluid which is available to the conveyor.

11. The spreader device as defined in claim 10, wherein said liquid delivery system further includes:

a flow meter to determine the rate of flow of the liquid.

12. The spreader device as defined in claim 1, wherein said hydraulic system further includes:

a first hydraulic pump operated through a power takeoff from an engine mounted on said vehicle;

a liquid system motor operatively driven by said pump and connected to a liquid system pump, said liquid system operative pump for moving the liquid from the storage tank to the delivery means;

a separate conveyor motor operatively driven by said hydraulic pump for operating said conveyor; and the further improvement in said control means comprises hydraulic flow control means including a direction flow control valve and a flow control valve mounted in line with said conveyor motor wherein said direction flow control valve directs all the hydraulic fluid from the first pump to the conveyor motor or to the flow control valve, said flow control valve directing a set portion of said hydraulic fluid to the conveyor motor and on activation of said liquid delivery system a remaining portion to the hydraulic reservoir, whereby the feed rate of the granular material delivery system is altered because of the reduced hydraulic fluid directed to the conveyor motor.

13. In a synchronized granular and liquid spreader device mountable on a vehicle and comprising a granular delivery system mounted on said vehicle for distributing granular material from a hopper, said hopper depositing said granular material onto conveyor means driven by a hydraulic system, said conveyor means for moving the granular material to a pre-selected delivery position at which delivery position delivery means receive and distribute said granular material; a liquid delivery system interconnected to said granular delivery system for a synchronous feed rate of the granular and liquid materials, said liquid delivery system for adding the liquid to the granular material generally at the delivery means; and control means for controlling the feed rate of the granular and liquid materials, the improvement in said control means comprising means for reducing by a selected percentage the feed rate of the granular delivery system upon activation of the liquid delivery system; and means for directly and proportionally changing the granular material feed rate as the liquid delivery feed rate is changed.

14. The spreader device as defined in claim 13, wherein the means for reducing the granular material feed rate includes means for sensing the commencement of liquid feed and means responsive to the sensing of commencement of liquid feed for adjustedly controlling the conveyor means.

15. In an apparatus for the synchronized spreading of granular and liquid materials onto a surface and comprising a granular material delivery system including a hopper for containing granular material, a spreader for distributing the granular material onto a surface, a conveyor for conveying the granular material from said hopper to said granular material spreader, a liquid material delivery system including a tank for containing liquid material, a spreader for distributing the liquid material onto said surface, a pump for pumping liquid material from said tank to said liquid material spreader, first means for driving said conveyor, second means for driving said pump, and means for controlling said first means and said second means, the improvement in said controlling means comprising means for controlling said first means and thereby the quantity per surface area of granular material to be applied to the surface, means for controlling said second means and thereby the amount of liquid per surface area applied to the surface as a function of the amount of granular material being applied to the surface and a selected ratio of liquid material to granular material, and means for variably controlling said first means in response to the activation of said second means, for reducing the quantity of granular material applied to the surface by a selected percentage of the material quantity applied prior to the activation of said second means.

16. In an apparatus for the synchronized spreading of granular and liquid materials onto a surface and comprising a granular material delivery system including a hopper for containing granular material, a spreader for distributing the granular material onto a surface, a conveyor for conveying the granular material from said hopper to said granular material spreader, a liquid material delivery system including a tank for containing liquid material, a spreader for distributing the liquid material onto said surface, a pump for pumping liquid material from said tank to said liquid material spreader, a first motor for driving said conveyor, a second motor for driving said pump, and means for controlling said first and second motors, the improvement in said controlling means comprising means for controlling said first motor as a function of a predetermined amount of granular material to be applied to the surface, means for adjustably controlling said second motor as a function of the amount of granular material to be applied to the surface and a selected ratio of liquid material to granular material, and means for variably controlling said first motor in response to the activation of said second motor for reducing the quantity of granular material applied to the surface by a selected percentage of the material quantity applied prior to the activation of said second motor.

17. In an apparatus for the synchronized spreading of granular and liquid materials onto a surface and comprising a granular material delivery system including a hopper for containing granular material, a spreader for distributing the granular material onto a surface, a conveyor for conveying the granular material from said hopper to said granular material spreader, a liquid material delivery system including a tank for containing liquid material, a spreader for distributing the liquid material onto said surface, a pump for pumping liquid material from said tank to said liquid material spreader, a first fluid pressure motor for driving said conveyor, a second fluid pressure motor for driving said pump, a pressure fluid pump for delivering pressure fluid to said first and second fluid pressure motors, and means for controlling the flow of pressure fluid to said first and second fluid pressure motors, the improvement in said controlling means comprising means for proportioning the flow of pressure fluid to said first and second fluid pressure motors as a function of a selected amount of granular material to be applied to the surface and a selected ratio of granular material to liquid material to be applied to the surface, and means for variably controlling said first fluid pressure motor in response to the activation of said second fluid pressure motor for reducing the quantity of granular material applied to the surface by a selected percentage of the material quantity applied prior to the activation of said second fluid pressure motor.

* * * * *